US008069793B2

(12) United States Patent
Rice

(10) Patent No.: US 8,069,793 B2
(45) Date of Patent: Dec. 6, 2011

(54) UNIVERSALLY MOUNTABLE MODEL TRAIN

(76) Inventor: Vic G. Rice, Baton Rouge, LA (US)

( * ) Notice: Subject to any disclaimer, the term of this patent is extended or adjusted under 35 U.S.C. 154(b) by 380 days.

(21) Appl. No.: 12/124,788

(22) Filed: May 21, 2008

(65) Prior Publication Data

US 2009/0288576 A1 Nov. 26, 2009

(51) Int. Cl.
*B61D 17/00* (2006.01)

(52) U.S. Cl. ..... 105/1.5; 105/157.2; 105/238.2; 105/29.2; 105/73; 105/77

(58) Field of Classification Search ..... 105/1.5, 105/157.2, 238.2, 29.2, 73, 77, 78
See application file for complete search history.

(56) References Cited

U.S. PATENT DOCUMENTS 2,838,009 A * 6/1958 Bonanno ..... 105/77
3,115,845 A * 12/1963 Girz ..... 104/119
3,540,153 A * 11/1970 Masaru ..... 446/446
3,831,527 A * 8/1974 Peterson ..... 104/130.07
4,221,076 A * 9/1980 Ozawa ..... 446/445
4,274,337 A * 6/1981 Shaw ..... 105/99
4,799,916 A * 1/1989 McKay et al. ..... 446/444
5,277,124 A * 1/1994 DiFonso et al. ..... 104/130.07
5,657,699 A * 8/1997 Bishop ..... 105/30
5,664,503 A * 9/1997 Kawai ..... 105/377.05
5,791,253 A * 8/1998 Schultheis et al. ..... 104/53
5,853,655 A * 12/1998 Baker ..... 266/44
7,451,708 B2 * 11/2008 Severson ..... 105/1.5
7,520,226 B2 * 4/2009 Webster et al. ..... 105/1.5
7,644,664 B2 * 1/2010 Nakao et al. ..... 104/243
2005/0120812 A1 * 6/2005 Edwin et al. ..... 73/865.8
2006/0213703 A1 * 9/2006 Long ..... 180/65.2
2008/0041267 A1 * 2/2008 Denen et al. ..... 105/1.5
2009/0288576 A1 * 11/2009 Rice ..... 105/1.5

* cited by examiner

*Primary Examiner* — Joe Morano, IV
*Assistant Examiner* — Jason C Smith
(74) *Attorney, Agent, or Firm* — West & Associates, A PC; Stuart J. West

(57) ABSTRACT

A model railroad train or other vehicle capable of operating in a vertical plane, inverted, or at any other desired angle of inclination.

16 Claims, 13 Drawing Sheets

UNIVERSALLY MOUNTABLE MODEL TRAIN

BACKGROUND

1. Field of the Invention

The present disclosure relates to the field of model trains, specifically those capable of being mounted on a vertical or inclined surface.

2. Background

Remotely controlled model vehicles such as cars and trains have been popular toys for adults and children alike for many years. Some of these vehicles are free-travelling, while others, such as slot cars and electric trains are constrained to a track. A user can control the speed of the vehicle, but the path remains fixed by the track.

Electric trains are generally comprised of an electrically powered scale model "locomotive," which pulls a number of non-powered "cars." Together, these components form the "train assembly" or "train." The train rides on a set of rails that are usually electrified and electrically insulated from one another. The rails are usually in a parallel configuration and connected by "ties" running perpendicular to the rails. These ties are then supported by a base structure called the "bed." The rails, ties, and bed are collectively called the "track assembly." A "layout" consists of a track assembly and at least one train mounted on a planar surface that can be decorated to resemble terrain, town, or other desired setting.

As the train sits on the rails, gravity holds the components on the rails, and the weight of the components provides the required friction to propel the train along the track and keep the train on the track assembly. To prevent "derailing," and improve the stability of the train, the cars are often weighted. Electrical power is transferred to the locomotive via the rails to move the train along the track.

Due to need for contact of the locomotive with the rails to have the power to drive the train, as well as the frictional force needed to propel the wheels along the track, model train layouts are mounted horizontally. Although this is a convenient for accessing the layout and is aesthetically pleasing, it can take up a great deal of space and can be inconvenient to store.

What is needed is a model train layout capable of being mounted vertically or at any angle. This could provide a novel twist on a traditional hobby, as well as solve the storage problems presented by conventional model train layouts.

DETAILED DESCRIPTION

Figure 1:
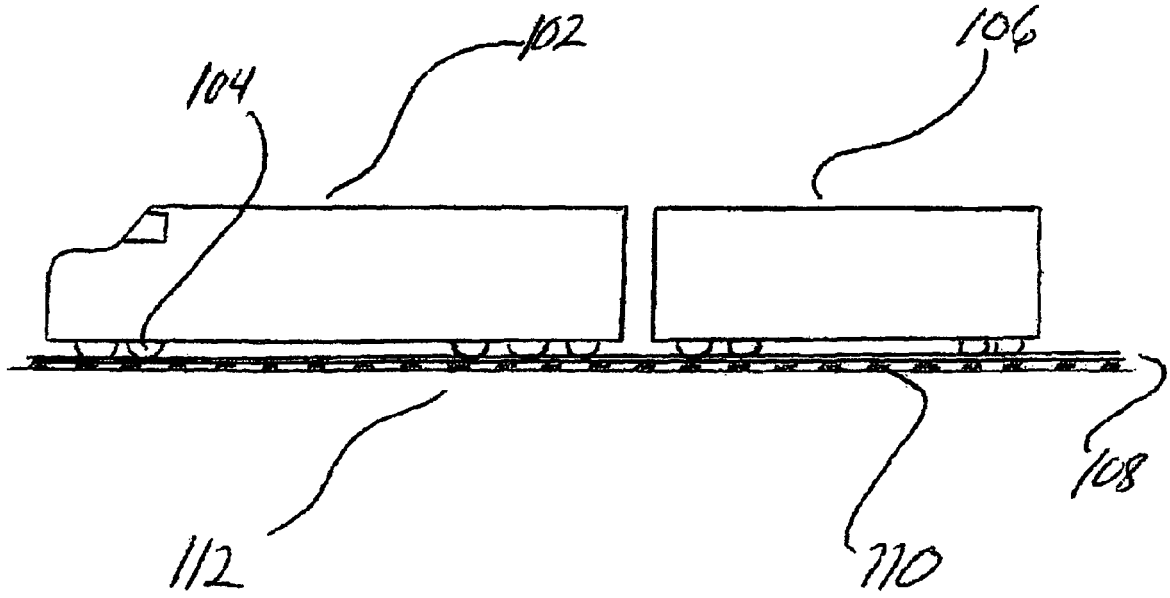
FIG. 1 shows a side view of one embodiment of the present device.

FIG. 1 depicts a side view of one embodiment of the present device. A scale model locomotive engine 102 or any other desired type of vehicle houses a standard electric motor. A plurality of wheels 104 allow a locomotive 102 to roll along a track 106 having at least one rail 108. In embodiments having at least two substantially parallel rails 108, a plurality of ties 110 can connect these rails 108. At least one additional car 112, also having at least one wheel 104 can be pulled or pushed along a track 106.

Electrical power can be run through rails 108 and provide electrical power to a locomotive 102 via an electrical connection between rails 108 and wheels 104. A standard motor within a locomotive 102 can then drive at least one wheel 104 to move a train along a track 106. This can be accomplished through any known and/or convenient control circuit.

Rails 108 can have a quadrilateral, I-beam, L-beam, or any other known and/or convenient cross-section.

In some embodiments of the present device, a plurality of wheels 104 can be magnetically attracted to rails 108. In such embodiments either wheels 104, rails 108, both of these components, or any other known and/or convenient components of a train or layout can be made of a magnetic material, such as, but not limited to ferromagnetic materials and ceramic magnets based on neodymium compounds. In some embodiments, rails 108 can be magnetized by the action of an electric current through the rails 108. In other embodiments, wheels 104 can be magnetized by the action of an electric current through the wheels 104.

Figure 2:
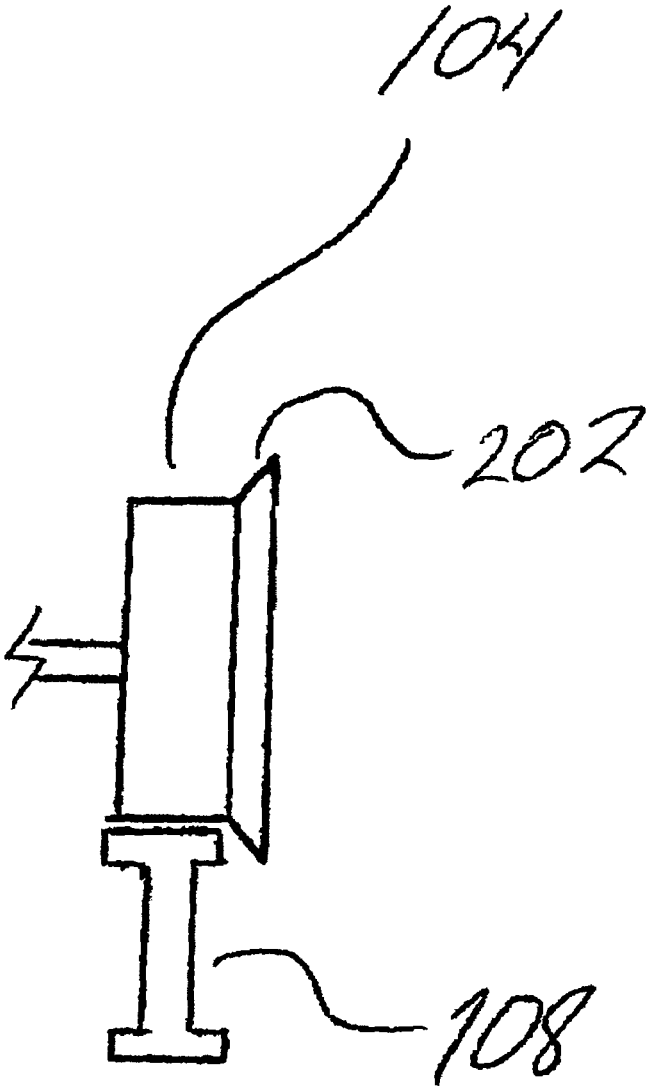
FIG. 2 shows an end view of a wheel of another embodiment of the present device.

In some embodiments, as shown in FIG. 2, wheels 104 can have a flange 202 extending past a top interior or exterior edge of a rail 108 to restrict lateral motion of a locomotive 102 and/or car 106.

Figure 3:
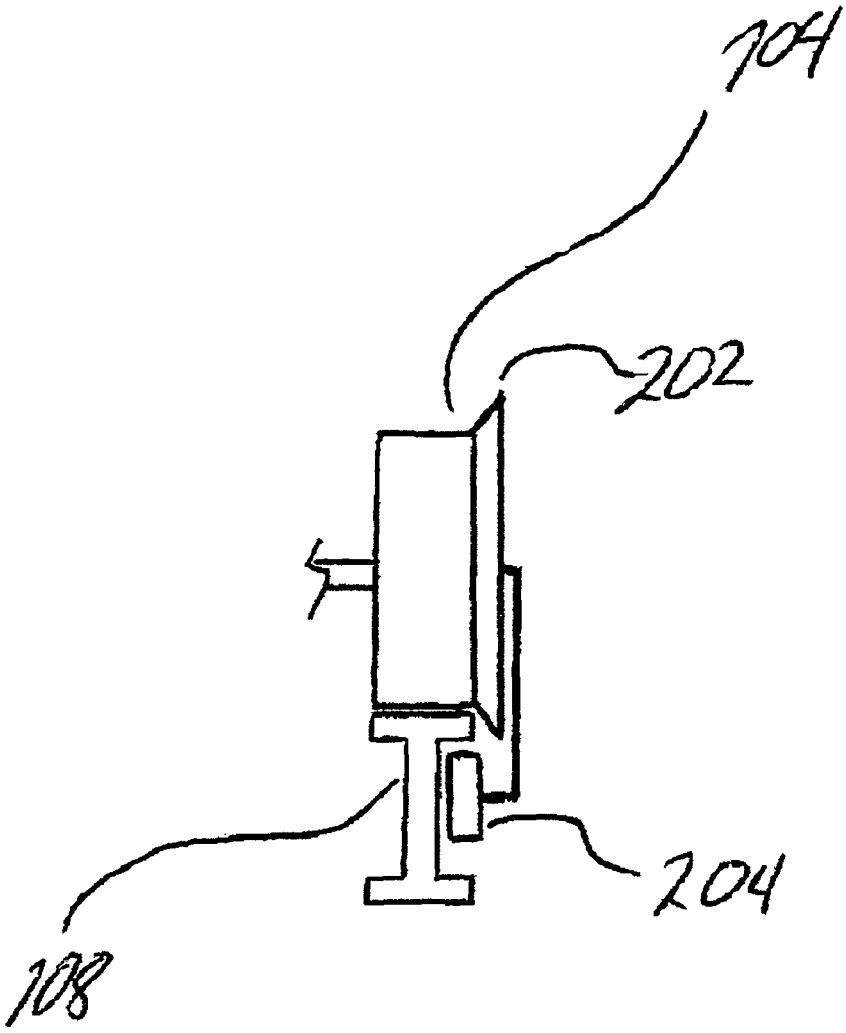
FIG. 3 shows an end view of a capture wheel in another embodiment of the present device.
Figure 3A:
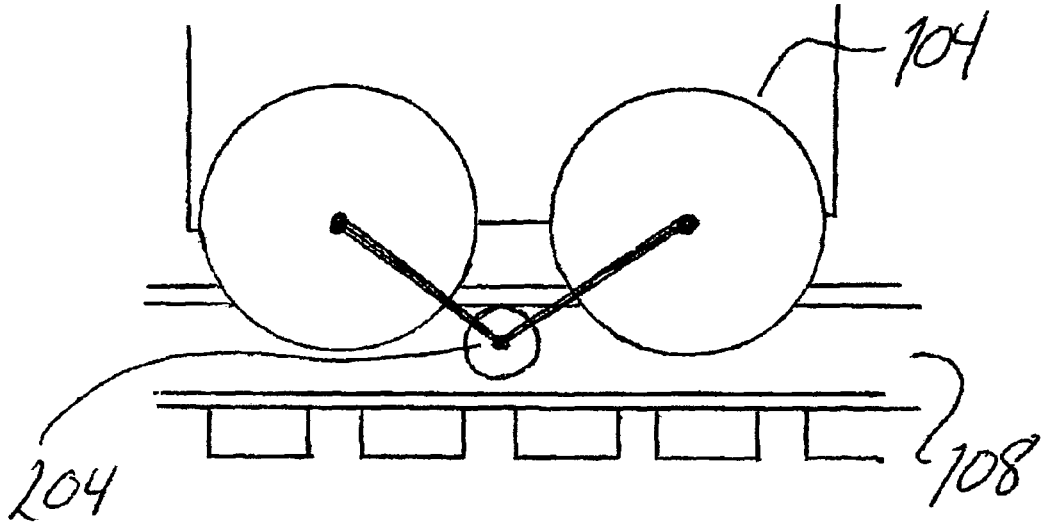
FIG. 3*a* shows a side view of the embodiment of the present device shown in FIG. 3
Figure 3B:
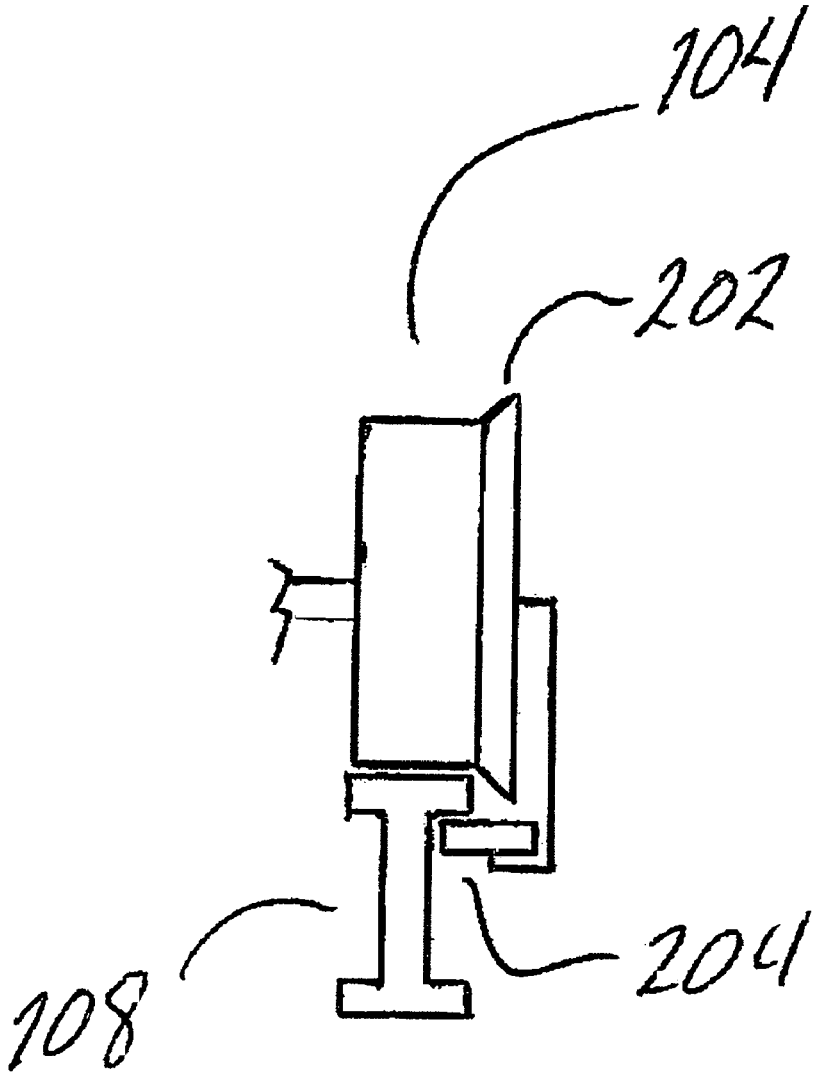
FIG. 3*b* shows an end view of a capture wheel on another embodiment of the present device.

In some embodiments, an additional set of "capture wheels" 304 can hold a locomotive 102 or a car 106 on a rail 108. As shown in FIG. 3 and FIG. 3*a*, capture wheels 304 can run under an interior or exterior top flange of a rail 108 and be oriented parallel to wheels 104. Capture wheels 204 can be located directly beneath wheels 104, between sets of wheels 104, as shown in FIG. 3*a*, or at any other known and/or convenient location. In other embodiments, as shown in FIG. 3*b*, capture wheels 304 can be oriented perpendicular to wheels 104 and contact the interior or exterior lateral edge of a rail 108.

Figure 4:
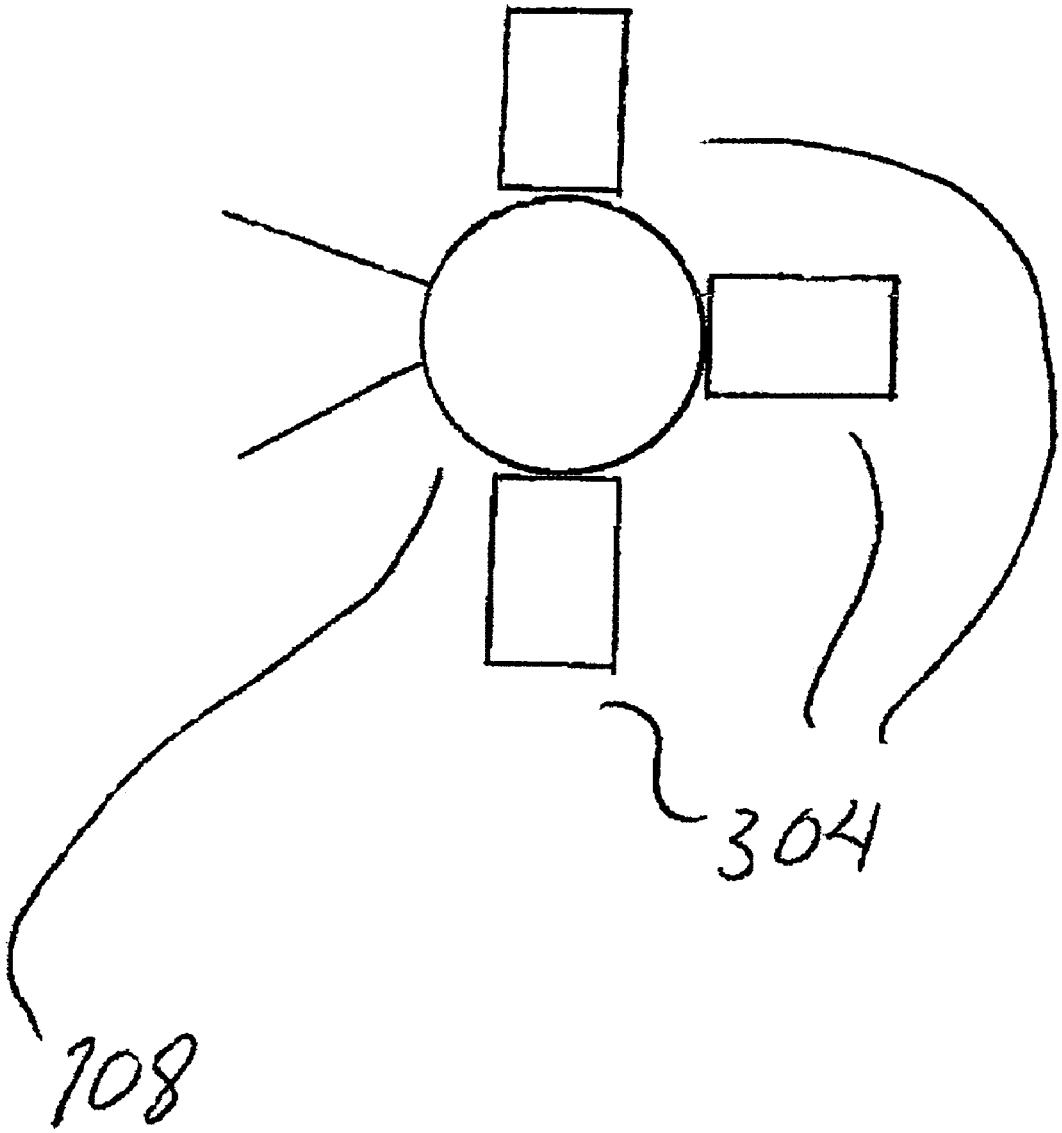
FIG. 4 shows an end view of a set of capture wheels in another embodiment of the present device.

In other embodiments, as shown in FIG. 4, capture wheels 304 can surround a rail 108 at three points on the surface of a rail 108, while a rail 108 can be supported at a fourth point. In these embodiments, a rail 108 can have a substantially circular cross section, or any other known and/or convenient geometry.

Figure 5:
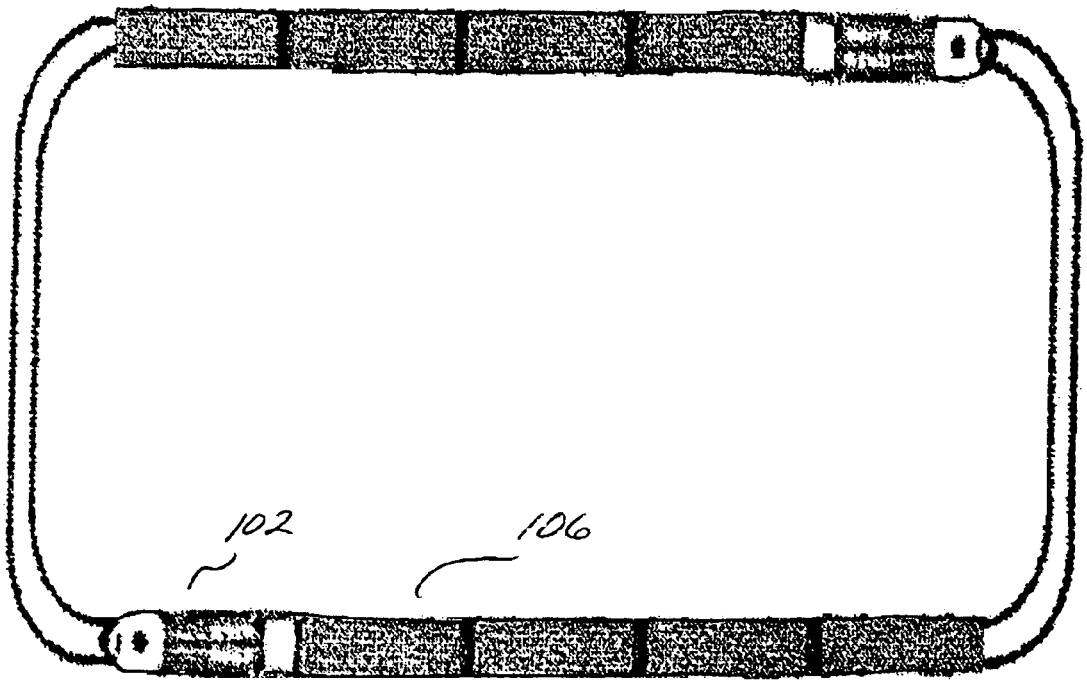
FIG. 5 shows a top view of a layout of one embodiment of the present device.

FIG. 5 depicts one possible layout configuration for the present device. A train can travel in a horizontal path to the left and the right, as well as vertically up and vertically down. When travelling in the horizontal plane, gravitational force exerted on cars 106 and or a locomotive 102 does not affect the load on the motor. However, the weight load of a locomotive 102 and cars 106 on a locomotive 102 is "negative" and increases as a train moves in the vertically upward direction, pulling a train backward along a track. The weight load is "positive" as a train moves in the vertically downward direction, pulling a train forward along a track. Therefore, when a train travels up in the vertical direction, additional drive force is needed to overcome the pull of gravity backward on a train. Likewise, when a train travels down in the vertical direction, a train can require a braking force to counter the additional pull of gravitational force in the downward direction of travel.

As a train travels around a track, the gravitational force of a locomotive 102 and cars 106 on a locomotive 102 will increase incrementally as each car turns orientation from "horizontal" to "vertical." As a result, the locomotive 102 power can adjust to accommodate the changes that occur as a train goes from horizontal to vertical travel. A sensor can be placed in a locomotive 102, at least one car 106, or at the coupling between a locomotive 102 and a car 106, or on a motor in a locomotive 102. A sensor can be mechanical, electrical, digital, or any other known and/or convenient device. A sensor can detect the change of load as a train moves between horizontal and vertical orientations, the change of load on a motor, or any other known and/or convenient quantity.

In some embodiments, as shown in FIGS. 6*a*-6*d*, a sensor 602 can be an electromechanical device that can detect the direction of travel and adjust power accordingly. In some embodiments, a sensor 602 can be a gravity-based digital switch. A circuit contact 604 can move to positions within a sensor 602 corresponding to the orientation of travel. As a train moves in a horizontal path, a circuit contact 604 can rest in a neutral position where in does not trigger any change to the power of a locomotive 102. As a train moves in a vertical path, a circuit contact 604 can move into positions to complete a circuit that can augment 606 or retard 608 the power of a locomotive 102.

Figure 6A:
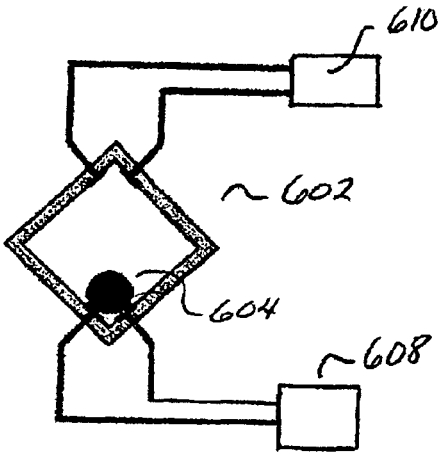
FIGS. 6*a*-6*d* show a series of schematics of one embodiment of a control sensor for the present device.

FIGS. 6*a*-6*d* show a sensor 602 as a train moves through "upward vertical" to "horizontal right," to "vertical down," to "horizontal left orientations of travel. In FIG. 6*a*, a sensor 602 is in the "vertical up" position. A circuit contact 604 can rest in a position so as to complete a circuit 606 that can provide additional power to a locomotive 102.

Figure 6B:
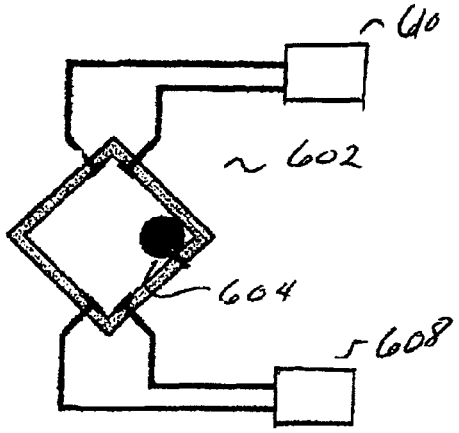

In FIG. 6*b*, a sensor 602 is in the "horizontal right" position. A circuit contact 604 can rest in a position such that it does not contact any additional circuits that can affect the power of motor.

Figure 6C:
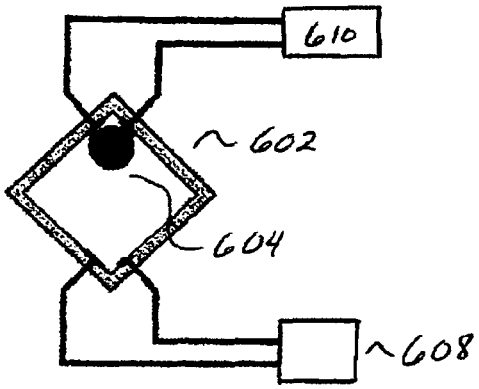

In FIG. 6*c*, a sensor 602 is in the "vertical down" position. A circuit contact 604 can rest in a position so as to complete a circuit 608 that can diminish the power of a locomotive 102. A circuit 608 can cause a decrease the electrical power to a motor or control a braking mechanism 610, which can be accomplished by drive train resistance, mechanical or electromechanical brakes, or any other known and/or convenient device. Further a braking system 610 can be installed on a locomotive 102, some or all cars 106, and can be controlled by mechanical, electromechanical, digital, or any other known and/or convenient means.

Figure 6D:
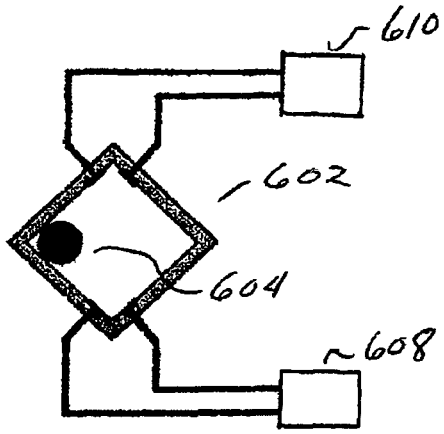

In FIG. 6*d*, a sensor 6 is in the "horizontal left" position. Again, a circuit contact 604 can rest in a position such that it does not contact any additional circuits that can affect the power of motor.

Figure 7:
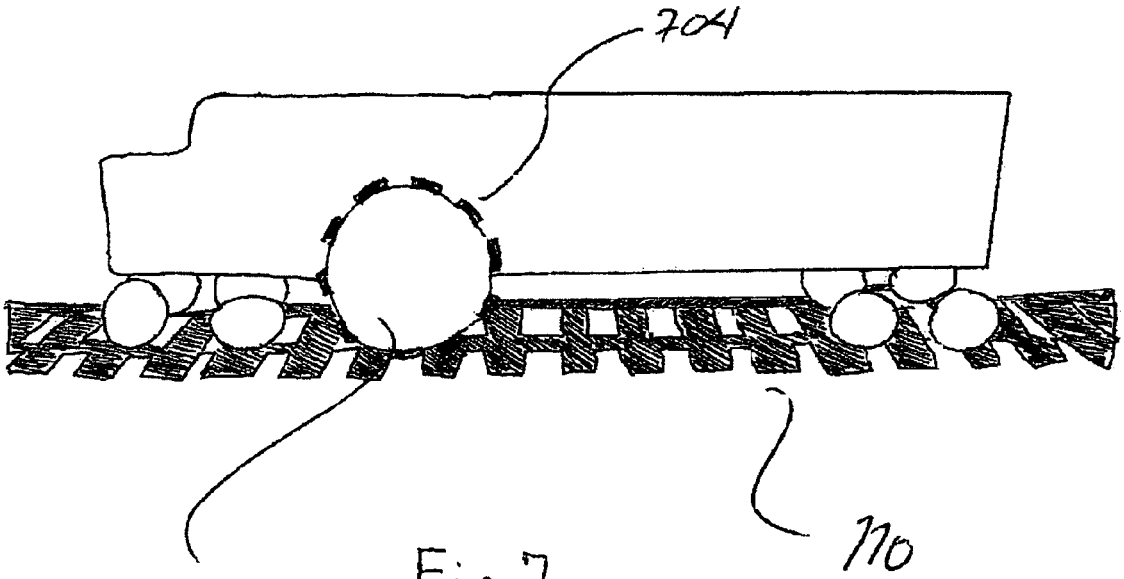
FIG. 7 shows another embodiment of the present device having an additional drive wheel.
Figure 7A:
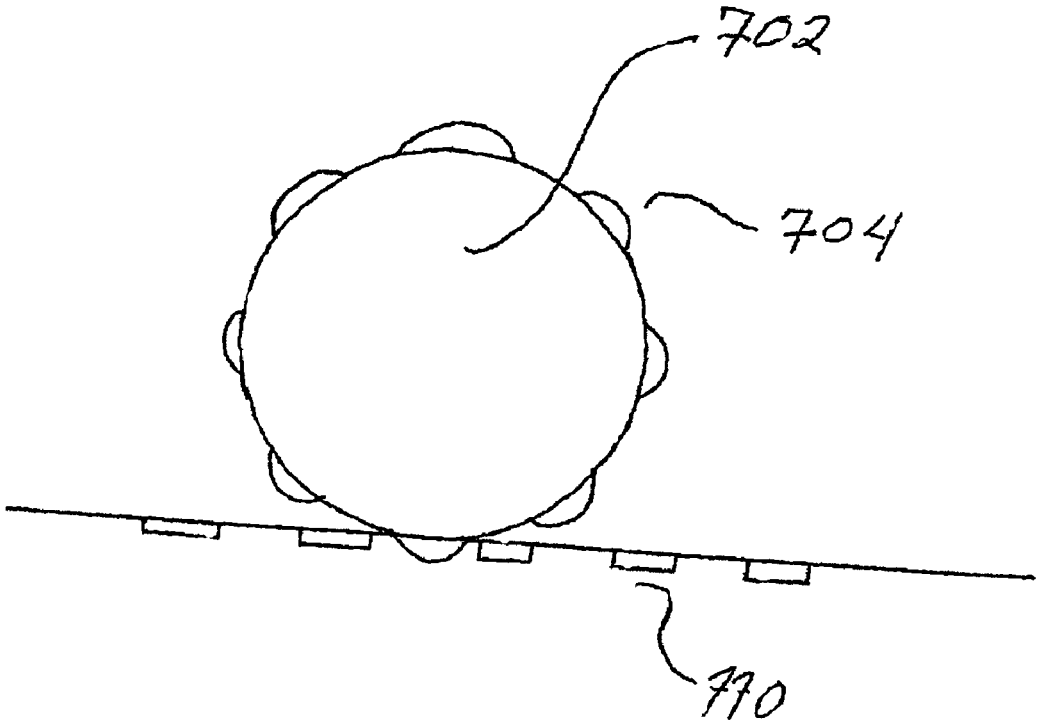
FIG. 7*a* shows another embodiment of a drive wheel in another embodiment of the present device.

In some embodiments, as shown in FIG. 7, the present device can have an additional mechanism to provide a driving force to compensate for the lack of frictional force usually provided by gravity as a train sits on the tracks in a conventional horizontally flat layout. As shown in FIG. 7, some embodiments can have at least one drive wheel 702 having a plurality of protrusions 704 on its outer perimeter. Protrusions 704 can be of a geometry such that protrusions 704 can interlock with track ties 110 to form a "gear-tooth" arrangement. Protrusions 704 can have a rectangular cross-section, or can have rounded edges, as shown in FIG. 7*a*, or any other known and/or convenient cross-sectional geometry to facilitate interlocking with track ties 110. In alternate embodiments, a drive wheel 702 can provide additional drive force by frictional contact with ties 110, a layout bed 112, or any other known and/or convenient surface.

Figure 7B:
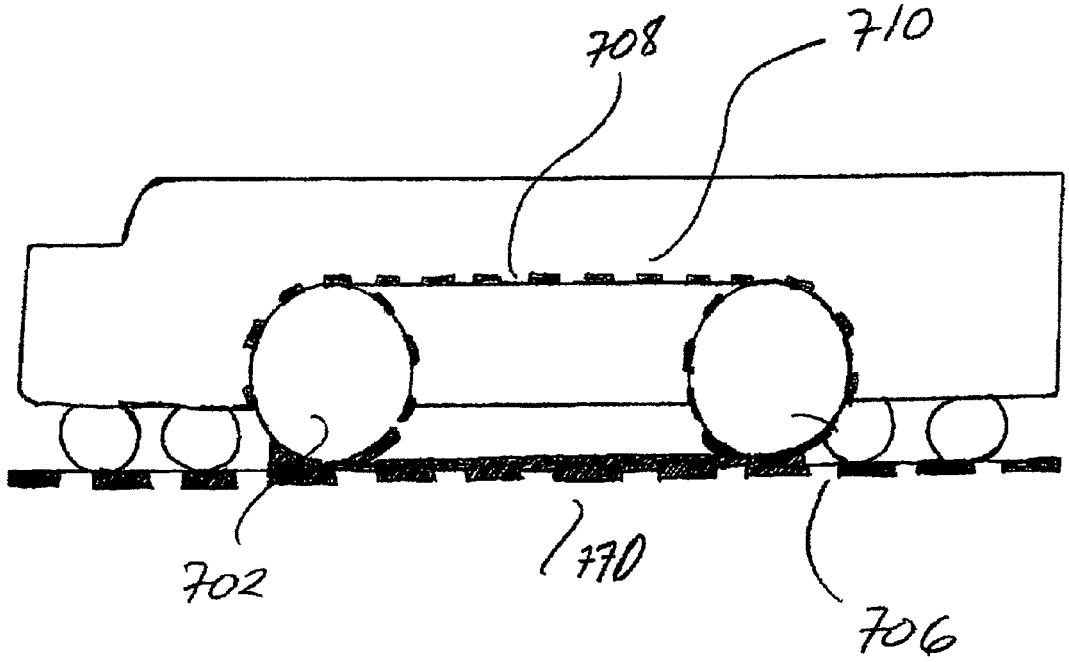
FIG. 7*b* shows another embodiment of the present device having an additional idler wheel and a tie belt.

In other embodiments, as shown in FIG. 7*b*, a drive wheel 702 can be linked to an idler wheel 704 via a tie belt 706 that can have protrusions 708 that can interlock with track ties 110. Protrusions 708 can have a rectangular cross-section, or can have rounded edges, or any other known and/or convenient cross-sectional geometry to facilitate interlocking with track ties 110. In alternate embodiments, a tie belt 706 can provide additional drive force by frictional contact with ties 110, a layout bed 112, or any other known and/or convenient surface.

Although depicted in FIGS. 7 and 7*b* as exposed to view, in some embodiments a drive wheel 702 or drive wheel 702/idler wheel 704/tie belt 706 combination can be contained within the body of a locomotive 102 and visually minimized.

Figure 8:
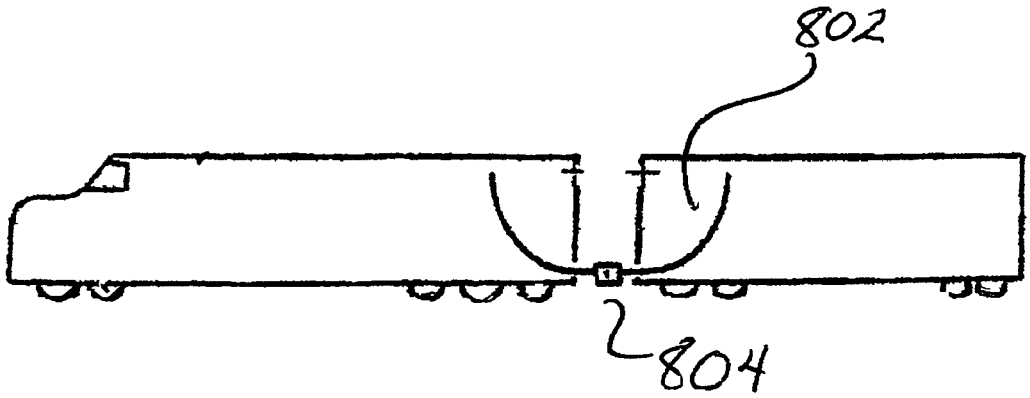
FIG. 8 shows another embodiment of the present device having a variable-length coupling.

As shown in FIG. 8, some embodiments of the present device can include at least one coupling 802 that can allow a train to travel between surfaces of different inclinations, such as, but not limited to, from horizontal to vertical. In some embodiments, couplings 804 can be of any known and/or convenient radius of curvature and be configured as a pair about a pivot point 804 that can be oriented substantially between two cars 106 or between a car 106 and a locomotive 102. In other embodiments, a coupling 802 can be a flexible member or any other known and/or convenient device.

Figure 8A:
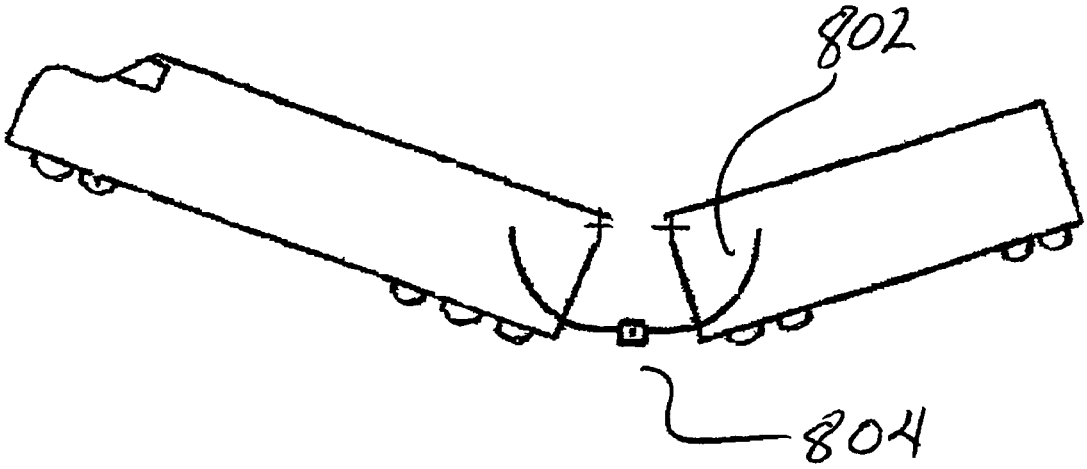
FIG. 8*a* shows the embodiment of FIG. 8 in use.

As shown in FIG. 8*a*, as a train travels into another plane having a different angle of inclination, a coupling 802 can allow the spacing between cars 106 and/or a car 106 and a locomotive 102 to vary, thus keeping a train in contact with at least one rail 108.

In another embodiment of the present device, the above-discussed components can be packaged as a retrofitting kit for conventional model trains. Such a kit can include wheels, magnetic components, additional capture wheels, replacement wheel trucks, train car couplings, other modifying devices for cars or a locomotive, a sensor and feedback mechanism, at least one additional drive wheel, or any other known and/or convenient device. In such embodiments, a user could use a retrofitting kit to make a conventional model train capable of running on a vertical surface, upside-down, or any other desired angle of inclination.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A model train system comprising:

a locomotive;

wherein said locomotive houses a motor;

at least one additional car;

wherein said locomotive and at least one additional car have at least one wheel;

a track having at least one rail; and a bed supporting said track;

wherein said locomotive includes at least one additional drive wheel capable of exerting a force parallel to said track;

wherein said locomotive further comprises a sensor and feedback mechanism adapted to detect the direction of travel of the locomotive and to adjust power delivered to the locomotive based at least in part on the direction of travel of the locomotive;

wherein said at least one additional car and said locomotive are adapted to be selectively magnetically coupled with said at least one rail, such that said locomotive and said at least one additional car can travel in an inverted configuration along said at least one rail, and such that when travelling in an inverted configuration, the sum of the forces acting on said locomotive and said at least one additional car in the plane orthogonal to the longitudinal axis of said at least one rail is substantially zero.

2. The device of claim 1, further comprising a pair of rails and a plurality of ties running substantially perpendicular to said rails.

3. The device of claim 2, wherein said at least one car further comprises a sensor and feedback mechanism to adjust power delivered to the locomotive as a function of the direction of travel of the locomotive.

4. The device of claim 2, wherein said wheels and said at least one rail are magnetically attracted to each other.

5. The device of claim 2, further comprising at least one capture wheel.

6. The device of claim 5, wherein said at least one capture wheel is positioned underneath the top edge of a rail.

7. The device of claim 5, wherein said at least one capture wheel is positioned substantially perpendicular to the outer surface of said rail.

8. The device of claim 2, wherein said drive wheel further comprises a plurality of protrusions capable of interlocking with said track ties.

9. The device of claim 2, further comprising an idler wheel coupled to said drive wheel by a belt drive.

10. The device of claim 9, wherein said belt drive further comprises a plurality of protrusions capable of interlocking with said track ties.

11. The device of claim 2, wherein said at least one additional car, said locomotive, and said at least one rail are adapted to be selectively magnetically coupled, and wherein the weight of each of said locomotive and said at least one additional car, relative to said magnetic coupling, is such that said locomotive and said at least one additional car can travel in vertical and inverted positions along said at least one rail.

12. The device of claim 1, further comprising at least one coupling device capable of varying the spacing between adjoining train cars and between a car and a locomotive.

13. The device of claim 1, wherein said sensor and feedback mechanism is further adapted to actuate a braking mechanism when said locomotive is travelling in a substantially vertical downward configuration.

14. A retrofitting kit, comprising:

a locomotive;

wheels;

at least one magnetic component;

capture wheels;

wheel trucks;

train car couplings;

at least one rail;

a sensor and feedback mechanism adapted to detect the direction of travel of the locomotive and to adjust power delivered to the locomotive based at least in part on the direction of travel of the locomotive; and at least one drive wheel capable of exerting a force parallel to said at least one rail;

wherein in an assembled configuration, said locomotive is adapted to be selectively magnetically coupled with said at least one rail, such that said locomotive can travel in an inverted configuration along said at least one rail, and such that when travelling in an inverted configuration the sum of the forces acting on said locomotive in the plane orthogonal to the longitudinal axis of said at least one rail is substantially zero.

15. The device of claim 2, wherein said sensor and feedback mechanism comprises a gravity-based digital switch.

16. The kit of claim 14, wherein said sensor and feedback mechanism comprises a gravity-based digital switch.

* * * * *